US008328257B1

(12) United States Patent
La Coste

(10) Patent No.: US 8,328,257 B1
(45) Date of Patent: Dec. 11, 2012

(54) LINE RETRIEVAL SYSTEM

(75) Inventor: Lee A La Coste, Metairie, LA (US)

(73) Assignee: NXS Solutions, LLC, Lafayette, LA (US)

( * ) Notice: Subject to any disclaimer, the term of this patent is extended or adjusted under 35 U.S.C. 154(b) by 356 days.

(21) Appl. No.: 12/730,447

(22) Filed: Mar. 24, 2010

Related U.S. Application Data

(60) Provisional application No. 61/163,580, filed on Mar. 26, 2009.

(51) Int. Cl.
*B25J 1/04* (2006.01)
*B63B 21/54* (2006.01)

(52) U.S. Cl. .... 294/191; 294/175; 294/210; 114/230.25

(58) Field of Classification Search ..... 294/19.3, 294/175, 191, 209, 210, 26; 114/221 R, 114/230.25
See application file for complete search history.

(56) References Cited

U.S. PATENT DOCUMENTS

| | | | | | |
|---|---|---|---|---|---|
| 281,243 | A | * | 7/1883 | Dana | 119/801 |
| 402,786 | A | | 5/1889 | Tyler | |
| 465,577 | A | | 12/1891 | Kiefer | |
| 690,246 | A | | 12/1901 | Diepold | |
| 774,900 | A | | 11/1904 | Wilson | |
| 944,057 | A | | 12/1909 | Thelen et al. | |
| 1,344,224 | A | | 6/1920 | Gross | |
| 1,852,629 | A | | 4/1932 | Sturges | |
| 1,920,790 | A | | 8/1933 | Hendrie | |
| 2,550,770 | A | | 5/1951 | Calemmo | |
| 2,807,495 | A | * | 9/1957 | Pillstrom | 294/104 |
| 2,811,127 | A | | 10/1957 | Palsson | |
| 2,889,797 | A | | 6/1959 | Fox | |
| 3,022,763 | A | | 2/1962 | Turrentine | |
| 3,048,139 | A | | 8/1962 | Duckett | |
| 3,150,460 | A | | 9/1964 | Dees | |
| 3,224,404 | A | * | 12/1965 | De Jong | 114/230.25 |
| 3,574,900 | A | | 2/1968 | Emery | |
| 4,004,539 | A | | 1/1977 | Wesson | |
| 4,037,554 | A | | 7/1977 | Foscolo | |
| 4,302,869 | A | | 12/1981 | Hackney | |
| 4,787,660 | A | | 11/1988 | Mrazek | |
| 4,793,646 | A | | 12/1988 | Michaud, Jr. | |
| 4,881,338 | A | | 11/1989 | Lung | |
| 5,381,749 | A | * | 1/1995 | Larson | 114/221 R |
| 5,724,762 | A | | 3/1998 | Thompson | |
| 5,831,749 | A | | 11/1998 | Tseng et al. | |
| 5,941,587 | A | * | 8/1999 | Wolff et al. | 294/103.1 |
| 6,739,275 | B2 | | 5/2004 | Darling et al. | |
| 7,111,573 | B2 | | 9/2006 | O'Reilly | |
| 2008/0110000 | A1 | | 5/2008 | Orr | |

* cited by examiner

*Primary Examiner* — Dean Kramer
(74) *Attorney, Agent, or Firm* — Joseph T Regard Ltd plc

(57) ABSTRACT

A system for retrieving a rope, line, or cable for use in, for example, mooring marine vessels of various sizes and configuration, the exemplary embodiment of the present invention being particularly suitable for mooring sport fishing vessels or the like, wherein there is provided a hand held retrieval device having a shaft with a boat hook affixed to one end and a grasping area at the other, the boat hook having a unique configuration wherein the arm or free end of the hook has situated thereabout a compressible layer of material having a high friction coefficient, and the opposing shank section of the hook has emanating therefrom first and second, parallel edges forming a channel therebetween, the edges and free end spaced and positioned to form a highly effective line retrieval hook.

2 Claims, 3 Drawing Sheets

LINE RETRIEVAL SYSTEM

PRIORITY CLAIM

The present application claims the benefit of provisional patent application Serial Number 61163580 entitled VESSEL MOORING SYSTEM filed Mar. 26, 2009, listing as inventor Lee A La Coste.

FIELD OF THE INVENTION

The present invention relates to a system for retrieving a rope, line, or cable for use in, for example, mooring marine vessels of various sizes and configuration, the exemplary embodiment of the present invention being particularly suitable for mooring sport fishing vessels or the like, wherein there is provided a hand held retrieval device comprising a shaft having formed at one end a boat hook having a unique configuration.

BACKGROUND DISCUSSION of the INVENTION

In sport fishing and other uses of marine vessels, it is not uncommon to engage, via a line or the like, a fixed object such as an oil platform or a bridge, so as to allow the users to engage in fishing in the vicinity or other activity. A common problem with this endeavor relates to effective anchoring of the vessel to the object. Currents in the vicinity, waves, changing winds, and a lack of uniformity of the types and configurations of the objects to be engaged are but some of the problems.

Prior art methods include the use of a large hook at the end of a rope, which hook is used to engage a pylon or leg of the platform or other structure. The user would affix a first end of a rope to the hook, the other end of the rope to the vessel, pull up to the pylon, leg or other structural member, "hook" it with the hook, then back off the vessel downstream so that the current or wind keeps tension on the line, to maintain the hook against the structure. This method has its problems, as to limitations in the hook size and configuration, as well as the dubious safety issues associated with having to pull up to the structure so that the user can engage the hook, as well as retrieve it, especially in hostile conditions including high waves or such.

U.S. Pat. No. 3,022,763 teaches a "floating buoy retrieving hook" wherein a line is affixed to the buoy, which is thrown into the water and pulled until it comes across and hooks the line to be retrieved. This system would appear to require some ability on the part of the operator to throw or otherwise position the buoy on the other side of the rope to be retrieved from the vessel upon which the operator is based. Further, while the system may be effective to some degree in calm waters, it is questioned as to how well it would work in heavy weather or where large waves or currents are present.

U.S. Pat. No. 774,900, patented 1904, is an example of a grappling hook shown engaging piping "or other object" 12. The problem with grappling hooks is that lines of polyurethane or the like, which are commonly used for sporting boats for fishing or the like, appear to have a low friction coefficient, and too easily slip through the hook, even after it has been engaged.

U.S. Pat. No. 7,111,573 illustrates a hook affixed to a rope for mooring a watercraft, the hook including a clip function to retain the hook in place and prevent the rope from slipping therefrom.

U.S. Pat. No. 2,889,797 teaches a "boat hook" which has a unique configuration which may be twisted to engage the rope to prevent it from slipping therefrom.

U.S. Pat. No. 5,381,749 teaches a "boat mooring hook" which includes teeth along the inner perimeter of the hook, so as to engage the line to prevent slippage.

U.S. Pat. No. 4,004,539 teaches a telescoping "marine implement" which includes various configuration ends including a lasso-like rope loop for engaging a structure, as well as line retriever attachments and hooks of various configurations, none of which appear to be similar to that contemplated in the present invention. See also U.S. Pat. No. 6,739,275 and U.S. Pat. No. 2,811,127.

Each of the above devices have limited effectiveness when it comes to retrieving a line thrown about an object for mooring a vessel thereto. Accordingly, there exists a long felt, but unresolved need for a line retrieval device which effectively engages various diameter and material lines about diverse structures and environments.

GENERAL SUMMARY DISCUSSION OF THE INVENTION

The present invention relates to a line retrieval device for use in various capacities, including, for example, mooring a vessel, which is easier and safer to implement, in more diverse situations and environments, in a more reliable fashion than existing systems.

The present invention utilizes a rope or other line having first and second ends, the first end of which is preferably engaged to the vessel via cleat or the like, the second end is preferably weighted, although a weight is not absolutely required. Alternatively, the second end can have a floatation device affixed thereto.

In use, the second end is thrown over or an object in the vicinity of the vessel, and is retrieved from the vessel via the line retrieval device of the present invention, so that the line engages the object such that, with the second end retrieved and engaged to the vessel via cleat or the like, the vessel is moored to the object. As discussed, the object can be in the form of a oil platform, bridge, buoy, piling, or various other structures.

The preferred embodiment of the present invention utilizes a line retrieval device comprising a shaft, which may be telescoping in construction to selectively lengthen same, forming first and second ends having an adjustable length.

The first end of the shaft forms a handle area for grasping by the user, the second end having a tapered hook for retrieving the second end of the rope after it has been thrown about or over the object to which the vessel is to be moored, or portion thereof.

The hook of the present invention has a unique configuration, comprising a free end extending therefrom at an angle, referenced hereto as an arm, the arm having a length, while having a compressible frictional layer thereabout forming an exterior surface, the frictional layer comprising a material selected so to retard slippage once the hook engages the second end of the rope, so as to allow the user to engage and pull the second end of the rope toward the vessel once it has engaged the desired object or structure for mooring. Situated opposite the arm are first and second edges, shown in spaced, parallel alignment.

In usage, the hook, once it has engaged the line for retrieval and pulled by the user, effectively grips the line via three gripping actions, namely 1) as tension is placed on the rope, it is pulled into the hook taper, increasing the engagement of the rope; 2) as the rope is pulled into the hook taper and the tension increases, the compressible frictional layer is deformed about the rope, enhancing the gripping action of said frictional layer about a portion of the rope surface; and 3) as the tension increases, the first and second edges opposite the arm bite into the rope, to engage same, allowing the user to retrieve the rope and affix same to the vessel, mooring same to the structure.

The present invention thereby provides a more effective, easier to use, and safer method to effectively retrieve a line or the like.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1A:
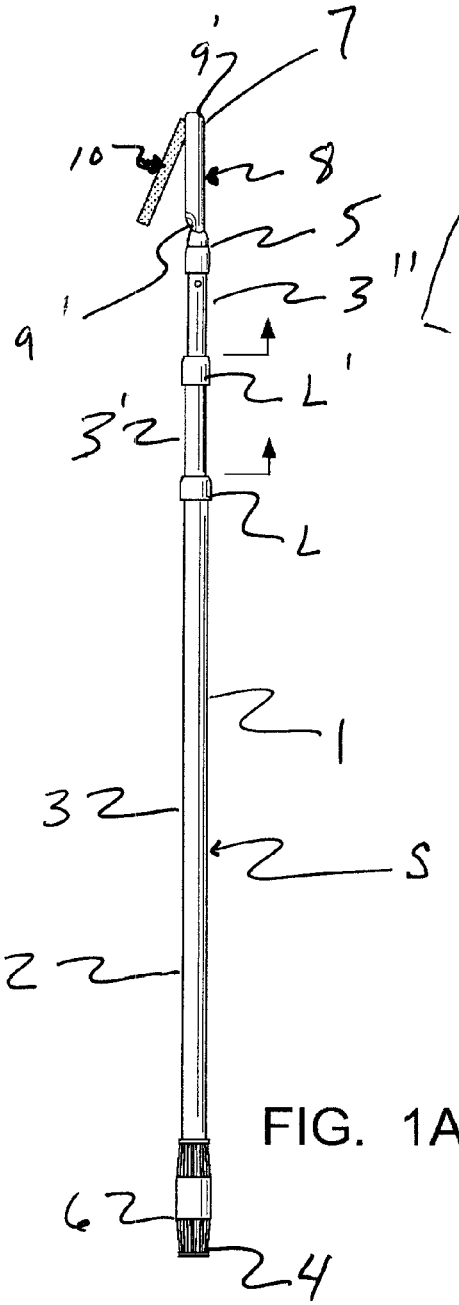
FIG. 1A is a side view of the exemplary line retrieval device, illustrating a telescoping shaft or pole having first and second ends, the first end of the shaft formed for use as a handle or grasping area by a user, the second end engaged to a hook for engaging a free end of a line to retrieve same in a mooring operation.
Figure 1B:
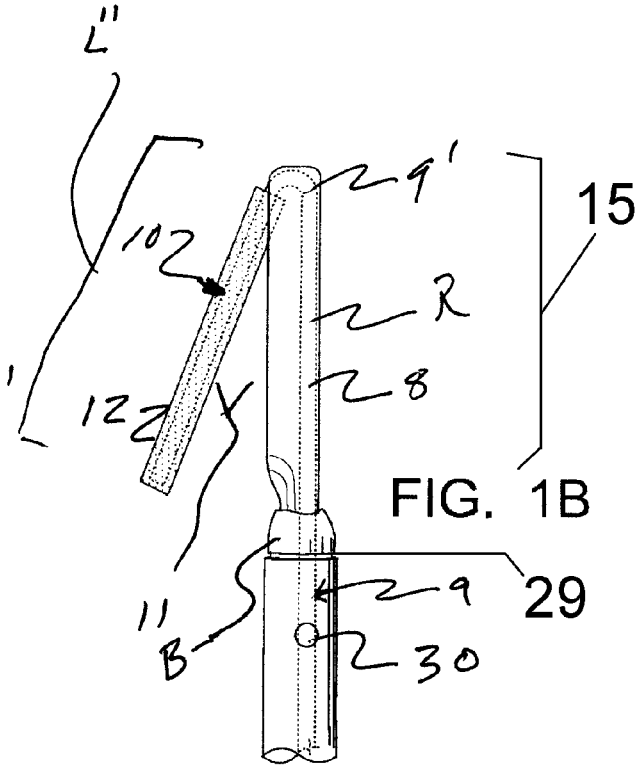
FIG. 1B is a close-up of the hook of the present invention and the various elements forming same.
Figure 3:
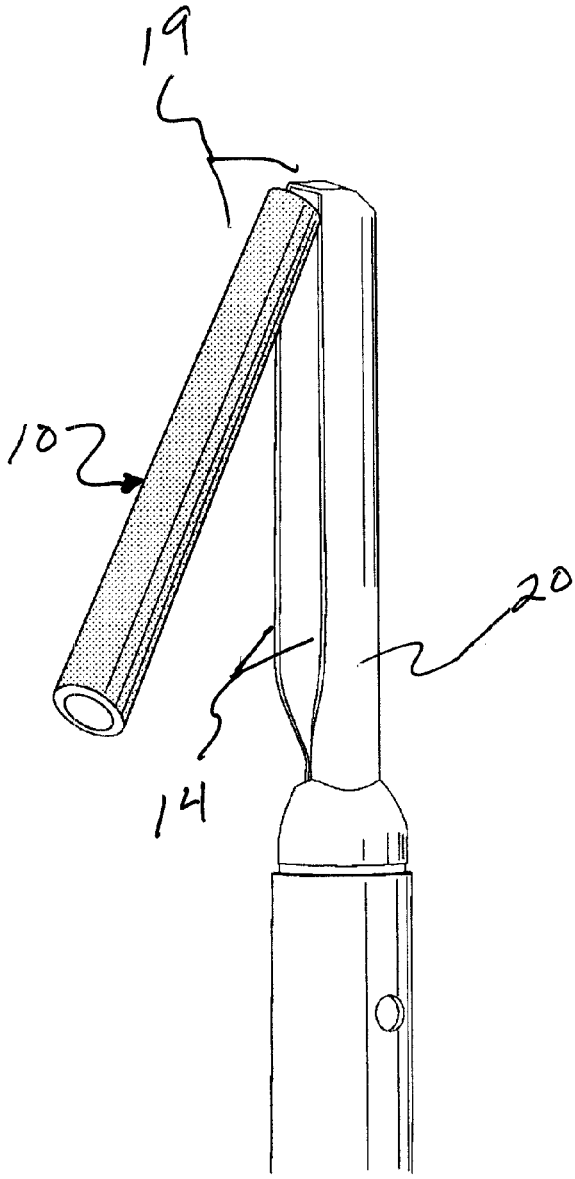
FIG. 3 is an isometric, close-up view of the hook of FIG. 1B of the present invention.

Referring to FIGS. 1A-1B and FIG. 3, the system S of the present invention includes a line retrieval device 1 having a shaft 2, which may be telescoping via three six foot slidingly engaging sections 3, 3', 3", forming a shaft having first 4 and second 5 ends having an adjustable length up to about eighteen (18) feet long. In the present exemplary embodiment, each shaft is formed of aluminum tubing, the first being 1⅛" diameter, the last being ⅞" in diameter. The first 4 end of the shaft 2 forms a handle area 6 for grasping by the user, the second end having a hook 7. The first two 3, 3' slidingly engaging sections may include locking rings L, L' which upon twisting, lock the sections into position.

The hook 7 comprises a shank 8 section having first 9 and second 9' ends formed preferably of stainless steel rod R for strength, the first end 9 of the shank emanating from the second end 5 of the shaft, the second 9' end of the shank 8 having emanating therefrom an arm 10 at an angle 11 toward the shaft. The total length of the exemplary device 1 in its contracted position shown in FIG. 1A is about six foot, eight inches (6' 8") long, making it facilitating easy storage on a watercraft or the like.

The angle 11 of the hook of the unit in the present embodiment is shown in FIG. 1A at about twenty-two (22) degrees, but can vary (for example, 10 to 45 degrees) depending upon a range of operational criteria including type, size and composition of line retrieved. Operational range of the hook angle is anticipated to be on the order of about 10-45 degrees.

Depending upon the material used, the arm 10 may be bendable somewhat to adjust the angle, to customize the configuration for the specific use. The exemplary arm shown is formed of type 304 stainless steel rod, about 5/15" in diameter. The arm 10 ideally has a length L" having a frictional covering 12 or coating of material about its exterior service to provide a high frictional coefficient even when wet, for engaging line during via of the hook, the frictional covering forming a first grabbing surface for the line or rope.

In the present working embodiment, neoprene is shown as the frictional covering 12, although it is believed that other materials such as other types of rubber or the like may also be suitable. It is further noted that the frictional covering (in this case, ¼" thick hose walls) may be compressible, so as to further facilitate a frictional "grabbing" of the object to which it is engaged. In the present embodiment, a neoprene ¼" hose is used, having about ¼" wall thickness.

Figure 2:
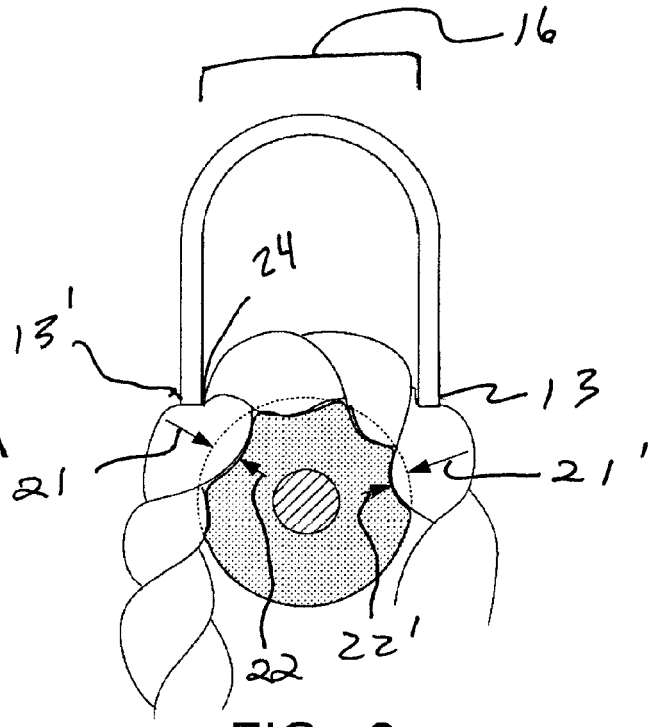
FIG. 2 is an end, cut-away up of the hook of FIG. 1B of the present invention illustrating the hook engaging a line, wherein the compressible frictional layer situated about the arm forming the free end of the hook is deformed about the rope so as to enhance the gripping action, while first and second edges opposite the arm bite into the rope, to engage same.

Continuing with the figures, particularly FIGS. 1B, 2 and 3, the rod forming the shank 8 of the hook 7 of the present invention preferably has situated thereabout a shank cover 20 (shown in type 304 stainless steel) formed to envelope a portion of the rod forming shank 8, while forming first 13 and second 13' aligned edges with a space or channel 14 there between having a width 16 sufficient to receive a portion of the rope therein, which edges face said arm 10 and which said edges are aligned with one another and at a uniform angle with regard to the arm 10 (previously indicated 22 degrees) so that the space between the arm 10 and edges 13, 13" tapers from wide (at the hook opening) to narrow (at the base or throat of the arm). This taper is such that, when a line is engaged by the hook, it slides along the arm to engage the two edges 13, 13', along with the frictional covering 12 about the arm. With tension, the grip on the line increases at the two edges 13, 13' bite into the rope, while applying pressure against the rope engaging the frictional covering, compressing said covering to enhance its grip, as will be further discussed infra.

The first end 9 of the shank 8, including the stainless rod and shank cover 20, engage a bushing B having a shoulder 29, which bushing is inserted into the second end 5 of the shaft, and secured via rivet 30 or the like which passes through shaft S into bushing B.

At the base 19 or throat of the hook, the edges 13, 13" are spaced as close as ⅛" from the rod, so that any line or rope situated there in is engaged simultaneously by the frictional covering 12 about the arm and the first and second edges 13, 13", the edges biting 21, 21' into the rope when tension is applied to grab same, with the tension also causing the rope to compress 22, 22' the frictional covering 12, especially in the vicinity of the channel 14 between edges 13, 13', enhancing the friction coefficient of the material and effectively grabbing the line or rope.

As shown, the first 13 and second 13' edges have a length 15 associated with the length of the shank adjacent to the arm, the space between the first and second edges being uniform and about or slightly greater than the width or radius of the arm, including the outer frictional layer. As discussed, a rod R may provided to form the core of the shank 8 to provide strength and rigidity.

In the present embodiment, the rod engages via bushing B the inner diameter of the second end of the shaft 2 forming the shank, then is bent to form the arm 10, although the arm may be otherwise formed. As shown, the metal used in forming the hook 7 in the exemplary embodiment comprises stainless steel, although other materials may also be utilized. Alternatively, the shank may be comprised solely of shank cover 20, with the rod welded to the second end (9') at an angle to form the arm 10.

Figure 4:
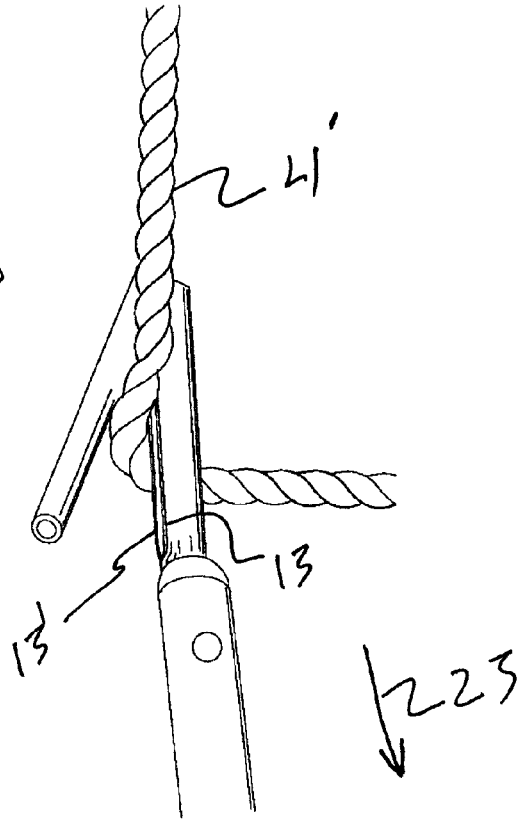
FIG. 4 is an isometric view of the hook of FIGS. 3 engaging a line for retrieval.

Referring to FIGS. 3 and 4, it is believed that the unique configuration of the hook, with the shank housing and its two aligned edges having a space therebetween as a component of the shank, and the angled arm with frictional exterior layer or coating, combined provide a superior grip for engaging a free length of rope, whether it be hanging from a structure or floating upon or situated in the water.

As shown in FIGS. 1A, 2, 3, 4 and 7, the rope 4' (or line), when engaged with the hook 7 and pulled 23 via the first end of the shaft by the user, upon engaging the hook 7, the rope slides along the tapering arm toward its base or throat at the shank (with edges 13, 13'), so that the rope is urged by the arm against and between the first 13 and second 13' aligned edges, a portion of the rope situated in the channel 14 (edges shown engaging grooves 24 in the surface of the rope), the narrow space at the base or throat 19 of the hook compressing the rope against the first 13 and second 13" edges, as well as the rope being compressed against the outer frictional covering 12 of the arm, so as to prevent slippage of the rope and retaining same in place, while retrieving the rope. Further, it has been found that the present system, while providing an excellent grip on the rope or line when retrieving the same, the grip is release able as the grip eases when the tension is relieved, the rope or line being easily removed from the hook once it is retrieved.

Figure 5:
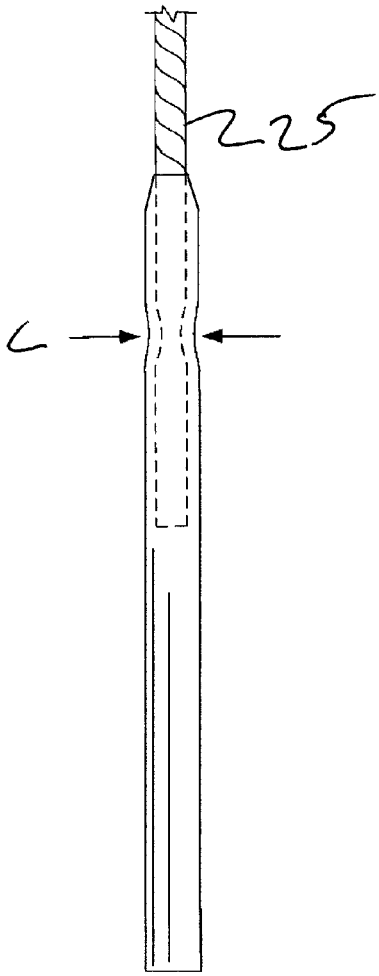
FIG. 5 is a view of an exemplary line which may be used with the present invention, wherein the free end of the line has a weight crimped thereto for throwing.
Figure 6:
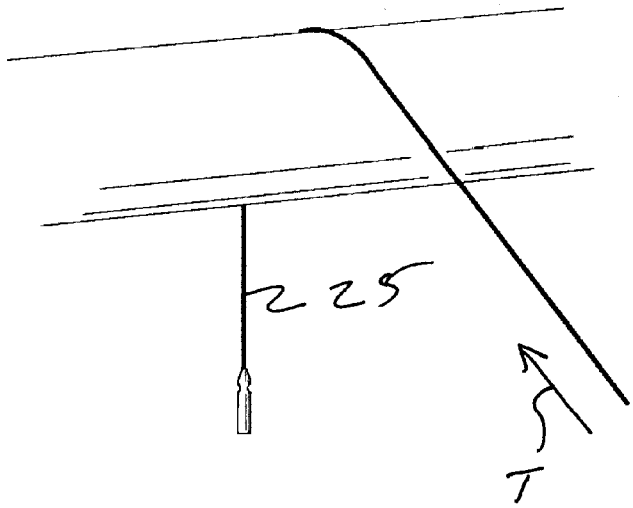
FIG. 6 is an isometric view of the system of the device of FIG. 1, illustrating a method of use wherein the free, weighted end of the line of FIG. 5 is positioned (for example, by being thrown by a user from a watercraft) about an object (for example, a structural support for a bridge) awaiting retrieval.
Figure 7:
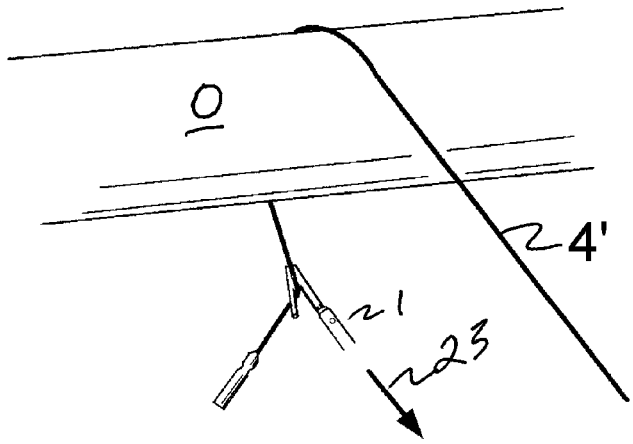
FIG. 7 is an isometric view of the method illustrated in FIG. 6, illustrating the use of the retrieval device to grasp (via the hook) the free end of the line and retrieving same.

Referencing FIGS. 5-7, the present embodiment of the invention utilizes a ⅜" POLY-DECK brand rope 4', fifty feet (50') long with a first end affixed to, for example, a water craft (via a cleat or the like), and the second end being the free end. The free end 25 of the rope may be weighted, although this is not absolutely required, and in some circumstances a float may be used instead of a weight. If a weight is used it may be crimped or otherwise affixed to the line to fix it in place.

As shown in FIGS. 4 and 5, in the preferred embodiment of the invention, the free end 25 of rope 4' has situated thereabout a weight W shown in the form of a length of stainless pipe having a crimp C or swage to affix same to the rope, to facilitate better throwing of same.

Referencing FIGS. 3-7, in use in mooring a vessel, water craft or other craft, the free end 25 of the rope 4' or line is thrown about or an object O in the vicinity of the user, and is retrieved from the user via said line retrieval device such that, with the second end retrieved and engaged to the craft via cleat or the like, the vessel is moored to the object.

In this case, the object shown is a horizontal structure such as a bridge guard or the like (although the system can be used with vertically oriented, or other structures as well), whereupon the free end 25 of the rope 4' is thrown T over the structure, whereupon the free end is retrieved 23 by the retrieval device 1 such that the rope passes about the structure, whereupon the free end is affixed to the craft, effectively mooring it to the bridge.

It is noted that, where one requires that the rope float, it may be required that the rope not be weighted. Alternatively, a weighted rope can be used in conjunction with a float or other flotation device affixed to the rope to keep the free end of the rope upon the water for retrieval. As discussed, the retrieval device, which may be extended if telescoping, engages the line via the hook for retrieval, in the manner earlier addressed.

RECITATION OF ELEMENTS

S System
L Locking rings
B Bushing
R Rod
O Object
C Crimp
W weight
T thrown
1 Retrieval device
2 Shaft
3, 3' engaging sections
4 first end
5 second end
6 handle
7 hook
8 shank
9, 9' first, second ends
10 arm
11 angle
12 frictional covering
13, 13' first and second edges of channel
14 channel
19 base or throat
20 shank cover
21, 21' edges biting
22, 22' rope compress
23 pulled or retrieved
24 rope grooves
25 free end of rope
29 shoulder The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A method of retrieving a line by a user, comprising the steps of:

a. providing an apparatus for retrieving a line, comprising:

a shaft having first and second ends, the first end forming a handle area;

a shank having first and second ends, said first end of said shank engaging said second end of said shaft;

an arm having a length engaging said second end of said shank, said arm positioned relative to said shank to form a hook;

a frictional covering situated along the length of said arm;

said shank further comprising first and second edges having a length, said length of said first and second edges being aligned to form a channel therebetween, said first and edges facing said arm;

b. positioning a free end of a line about an object;

c. engaging said free end of said line with said hook;

d. pulling said hook, allowing said line to engage said first and second edges of said shank and said frictional covering of said arm, so as to releasably grip same; and e. pulling said line to said user.

2. The method of claim 1, wherein, in step "a", said frictional covering comprises compressible material, and wherein in step "d", there is provided the added step "d (i) of pulling said line taut so that said line engages said frictional covering to compress said frictional covering, so as to enhance the grip of said frictional covering on said line.

* * * * *